US008429768B2

(12) United States Patent
Hanna

(10) Patent No.: US 8,429,768 B2
(45) Date of Patent: Apr. 30, 2013

(54) TOILET SEAT CONNECTOR

(76) Inventor: Brent Hanna, Lethbritlge (CA)

( * ) Notice: Subject to any disclaimer, the term of this patent is extended or adjusted under 35 U.S.C. 154(b) by 0 days.

(21) Appl. No.: 13/288,434

(22) Filed: Nov. 3, 2011

(65) Prior Publication Data

US 2012/0102634 A1 May 3, 2012

Related U.S. Application Data

(60) Provisional application No. 61/409,797, filed on Nov. 3, 2010.

(51) Int. Cl.
*A47K 13/12* (2006.01)

(52) U.S. Cl.
USPC ..... 4/240

(58) Field of Classification Search ..... 4/237, 240, 4/234, 236
See application file for complete search history.

(56) References Cited

U.S. PATENT DOCUMENTS

| | | | | |
|---|---|---|---|---|
| 3,086,223 | A * | 4/1963 | Gass | 4/237 |
| 5,778,460 | A * | 7/1998 | Doell et al. | 4/239 |
| 7,461,410 | B1 * | 12/2008 | Shaffer | 4/213 |
| 2009/0113611 | A1 * | 5/2009 | Jarjour et al. | 4/246.3 |
| 2010/0223719 | A1 * | 9/2010 | Hurt | 4/246.4 |

* cited by examiner

*Primary Examiner* — Lori Baker
(74) *Attorney, Agent, or Firm* — Davis & Bujold, PLLC

(57) ABSTRACT

A toilet seat connection for a toilet having a top bowl surface and side surfaces includes an elongate mounting bracket mounted to the bowl portion, the mounting bracket being connected to either side of the toilet, the mounting bracket being elevated above the top bowl surface and defining a space between a top bowl surface and the mounting bracket, and a toilet seat pivotally mounted to the elongate mounting bracket.

5 Claims, 2 Drawing Sheets

TOILET SEAT CONNECTOR

FIELD

There is described a connection that connects a toilet seat to a toilet bowl.

BACKGROUND

Toilet seats are usually connected directly onto a toilet bowl by a hinge mounted directly to the top surface of the tank.

SUMMARY

There is provided a toilet seat connection for a toilet having a top bowl surface and side surfaces. The toilet seat connection comprises an elongate mounting bracket mounted to the bowl portion, the mounting bracket being connected to either side of the toilet, the mounting bracket being elevated above the top bowl surface and defining a space between a top bowl surface and the mounting bracket, and a toilet seat pivotally mounted to the elongate mounting bracket.

According to an aspect, the bracket may be connected to either side of the toilet bowl. The toilet seat is pivotally mounted to the elongate mounting bracket by one or more hinges. The bracket may be spaced from a front of a toilet tank.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
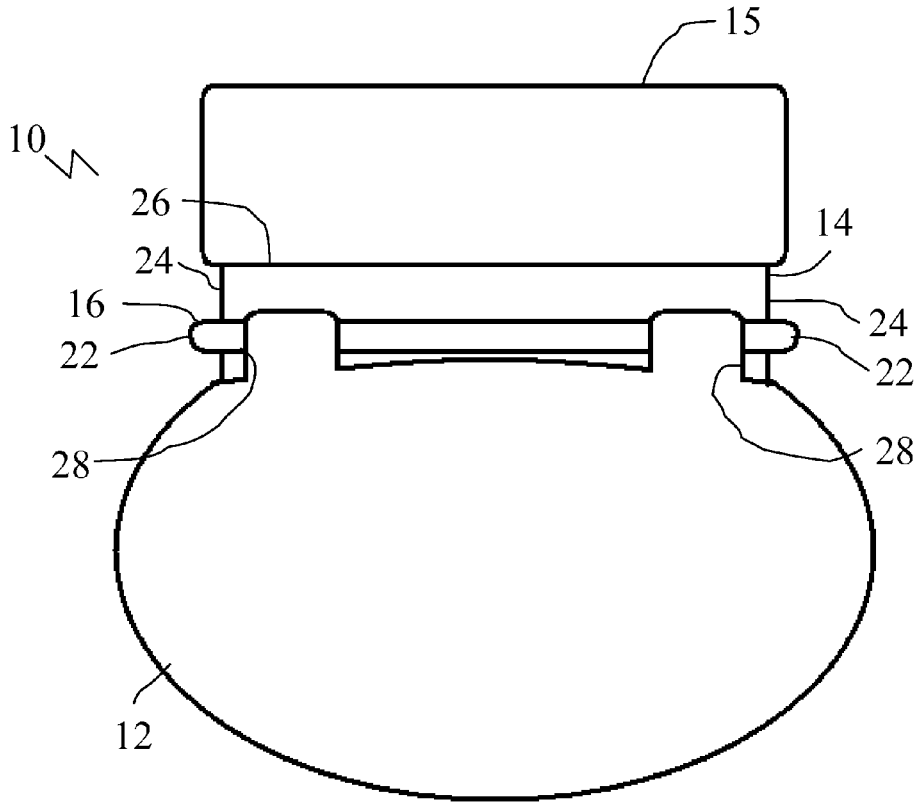
FIG. 1 is a top plan view of a toilet bowl and toilet seat.

A toilet seat connection generally identified by reference numeral 10, will now be described with reference to FIG. 1 through 2.

Figure 2:
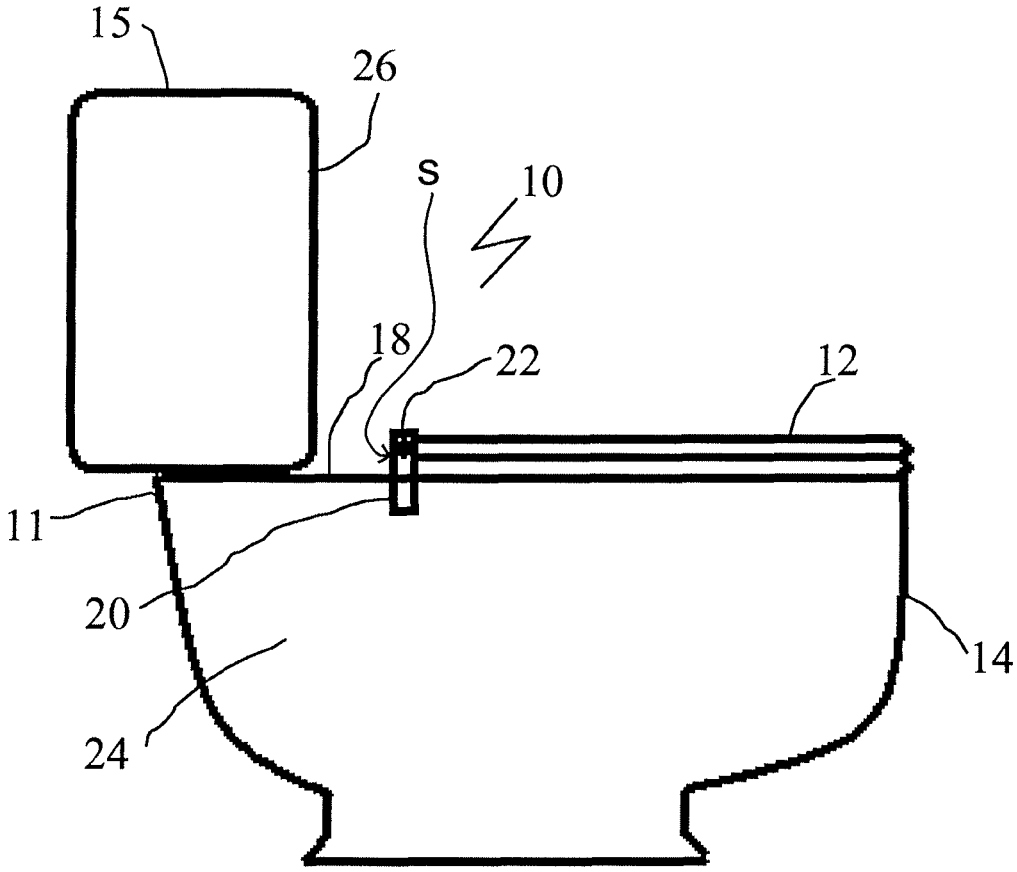
FIG. 2 is a side elevation view of the toilet bowl and toilet seat shown in FIG. 1

Structure and Relationship of Parts:

Referring to FIG. 1 and FIG. 2, a toilet seat connection 10 for connecting a toilet seat 12 to a toilet bowl 14 has an elongate mounting bracket 16 spaced from a top 18 of toilet bowl 14. Bracket 16 has connections 20 at each end 22 that connects bracket 16 to toilet bowl 14 such that, referring to FIG. 2, bracket 16 is elevated above toilet bowl 14. This provides a space S for the top surface of toilet bowl 14 to be cleaned. As shown, connections 20 connect to peripheral sides 24 of toilet bowl 14. It may be possible to connect bracket 16 to other parts of toilet 11 and maintain bracket 16 above the top surface of toilet bowl 14, although the sides of toilet bowl 14 are convenient locations. Referring to FIG. 1, at least one hinge 28 is pivotally connected to bracket 16 and a toilet seat 12 to allow toilet seat 12 to move between upright and horizontal positions. In the embodiment shown, two hinges 28 are used to pivotally connect toilet seat 12 to bracket 16. It will be understood that one or more hinges 28, or other pivoting connections, could equally be used.

Operation:

Referring to FIG. 1, toilet seat 12 and toilet bowl 14 are connected by bracket 16 spaced from the top surface 18 of toilet bowl 14 in front of the tank 15. Bracket 16 has connecting arms 20 at each end 22 that connect to toilet bowl 14. Referring to FIG. 2, bracket 16 is spaced far enough above toilet bowl 14 and away from the front 26 of toilet tank 15 to allow space to fit a cleaning implement, such as a rag, cleaning brush or the like, between toilet bowl 14 and bracket 16. Toilet seat 12 is pivotally connected to bracket 16 and movable between upright and horizontal positions.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A toilet seat connection for a toilet having a top bowl surface and side surfaces, the toilet seat connection comprising: an elongate C-shaped mounting bracket mounted vertically above the top bowl surface, the mounting bracket having vertically oriented connecting arms arranged at a proximate and distal end of said bracket, said arms extending downwardly, and connections at each opposed end thereof, said connections being connected only to the side surfaces on either side of the toilet bowl thereby leaving the top bowl surface clear of obstruction, the mounting bracket being elevated above the top bowl surface and defining a space for cleaning between a top bowl surface and the mounting bracket, and a toilet seat pivotally mounted to a top surface of the elongate mounting bracket.

2. The toilet seat connection of claim 1, wherein the toilet seat is pivotally mounted to the elongate mounting bracket by one or more hinges.

3. The toilet seat connection of claim 1, wherein the bracket is spaced from a front of a toilet tank.

4. A toilet seat connection for a toilet having a top bowl surface and first and second outwardly facing opposed side surfaces, the toilet seat connection comprising:

a generally C-shaped elongate mounting bracket mounted to the bowl portion, the mounting bracket being connected only to each of the first and the second outwardly facing opposed side surfaces of the toilet, the mounting bracket being spaced from and located vertically above the top bowl surface and defining a clearance space between the top bowl surface and the mounting bracket, with the clearance space being sufficient to permit insertion of a cleaning implement therebetween and facilitate unobstructed cleaning of the top bowl surface; and a toilet seat pivotally mounted to the elongate mounting bracket.

5. A toilet seat connection for a toilet having a top bowl surface and first and second outwardly facing opposed side surfaces, the toilet seat connection comprising:

an elongate mounting bracket mounted to the bowl portion, the mounting bracket being connected only to each of the first and the second outwardly facing opposed side surfaces of the toilet without contacting the top bowl surface, the mounting bracket being spaced from and located vertically above and extending parallel to the top bowl surface so as to define a clearance space between the top bowl surface and the mounting bracket with the clearance space being sufficient to permit insertion of a cleaning implement between the top bowl surface and the mounting bracket and facilitate unobstructed cleaning of the top bowl surface; and a toilet seat pivotally mounted to the elongate mounting bracket.

* * * * *